US011118425B2

(12) United States Patent
Harrigan et al.

(10) Patent No.: US 11,118,425 B2
(45) Date of Patent: Sep. 14, 2021

(54) PUMPDOWN REGULATOR

(71) Applicant: Halliburton Energy Services, Inc., Houston, TX (US)

(72) Inventors: Edward Harrigan, Richmond, TX (US); David Ronald Beard, Houston, TX (US); Randolph S. Coles, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 135 days.

(21) Appl. No.: 16/544,637

(22) Filed: Aug. 19, 2019

(65) Prior Publication Data

US 2021/0054718 A1 Feb. 25, 2021

(51) Int. Cl.

| | |
|---|---|
| ***E21B 34/10*** | (2006.01) |
| ***E21B 47/06*** | (2012.01) |
| ***E21B 23/01*** | (2006.01) |
| ***E21B 33/128*** | (2006.01) |

(52) U.S. Cl.

CPC ..... *E21B 34/10* (2013.01); *E21B 23/01* (2013.01); *E21B 33/128* (2013.01); *E21B 47/06* (2013.01)

(58) Field of Classification Search

CPC ..... E21B 21/10; E21B 21/103; E21B 34/101; E21B 34/103

See application file for complete search history.

(56) References Cited

U.S. PATENT DOCUMENTS

| | | | | |
|---|---|---|---|---|
| 3,434,534 A * | 3/1969 | Hollabaugh | ..... | E21B 43/24 166/53 |
| 4,078,810 A | 3/1978 | Arendt | | |
| 4,361,187 A | 11/1982 | Luers | | |
| 4,660,637 A * | 4/1987 | McGill | ..... | E21B 23/06 166/120 |
| 9,187,970 B2 | 11/2015 | Coles et al. | | |

(Continued)

FOREIGN PATENT DOCUMENTS

| | | |
|---|---|---|
| CA | 2879289 | 1/2014 |
| CA | 2911369 | 12/2014 |

(Continued)

OTHER PUBLICATIONS

International Search Report and Written Opinion for Application No. PCT/US2019/047336, dated May 19, 2020.

(Continued)

*Primary Examiner* — Giovanna Wright
*Assistant Examiner* — Ronald R Runyan
(74) *Attorney, Agent, or Firm* — John Wustenberg; C. Tumey Law Group PLLC

(57) ABSTRACT

This disclosure relates generally to downhole tools and, more particularly, embodiments related to incorporation of a pumpdown relief valve into a downhole tool that is responsive to changes in differential fluid pressure along a downhole tool. Disclosed is a system for pumpdown regulation in a wellbore. The system may include a downhole tool having a tool body with a tool head that is attachable to a line, the line being attached to a point at a surface of the wellbore. The system may further include a pumpdown relief valve coupled to the tool body that is operable to allow fluid to bypass the downhole tool in direct response to a differential fluid pressure across a length of the downhole tool.

20 Claims, 8 Drawing Sheets

(56) References Cited

U.S. PATENT DOCUMENTS

| | | | |
|---|---|---|---|
| 9,359,857 | B2 | 6/2016 | O'Malley |
| 9,617,814 | B2 * | 4/2017 | Seals ..... E21B 23/14 |
| 2002/0153142 | A1 | 10/2002 | Eslinger et al. |
| 2015/0083408 | A1 | 3/2015 | Coles |
| 2015/0330172 | A1 | 11/2015 | Allmaras et al. |
| 2018/0023369 | A1 | 1/2018 | Mebratu |

FOREIGN PATENT DOCUMENTS

| | | |
|---|---|---|
| EP | 2888444 | 11/2016 |
| EP | 3161242 | 5/2017 |
| WO | 2014209520 | 12/2014 |
| WO | 2016043760 | 3/2016 |
| WO | 2016080982 | 5/2016 |

OTHER PUBLICATIONS

Viassolo, D., Coles, R., Hill, J., & Seshadri, M. (2016). A Novel Method to Control Tool Transport in Well Intervention and Pumpdown Operations in Oil and Gas Services. SPE/ICoTA Coiled Tubing and Well Intervention Conference and Exhibition, SPE-179051-MS.

* cited by examiner

PUMPDOWN REGULATOR

BACKGROUND

In the drilling, completion, and stimulation of hydrocarbon-producing wells, a variety of downhole tools are used. For example, it is often desirable to seal portions of a casing string extended within the wellbore, such as during fracturing operations when various fluids are pumped from the surface into the casing string and forced out into a surrounding subterranean formation. Due to the existence of perforations at multiple locations in the casing, it becomes necessary to seal a portion of the cased hole and thereby provide zonal isolation. Wellbore isolation devices, such as packers and bridge plugs, are designed for these general purposes and are well known in the art of producing hydrocarbons, such as oil and gas. Wellbore isolation devices may be used on a tool string that includes a perforating gun. The wellbore isolation device may be used for isolation of the interval being perforated.

Wellbore isolation devices may be run into a wellbore on a line that extends into a wellbore from a point at the surface. Suitable lines may include, but are not limited to, wireline, slickline, braided line, and coiled tubing, among others. One technique for placing the wellbore isolation device (or other downhole tool) in the wellbore is commonly referred to as "pumpdown." In pumpdown, the downhole tool is conveyed into the wellbore using hydraulic pressure applied from the surface. For example, a fluid may be pumped into the wellbore to convey the downhole tool down the wellbore by hydraulic pressure on the downhole tool. Pumpdowns in horizontal wells, however, are often complicated when there is a change in effective flow area in the annulus between the downhole tool and the casing due to variations in the casing pipe diameter or if there is sand, wellbore debris, or other downhole obstructions built up or otherwise disposed within the well or casing string. When the downhole tool reaches such downhole obstructions, it tends to cause rapid accelerations and decelerations of the string and can result in rapid variations in the hydraulic pressure driving the string.

Since the surface pumps and line spooling are maintained at a relatively constant rate at surface, any mismatch between the speed of conveyance of the downhole tool and the speed of spooling of the line from the surface can result in a surge of cable tension at the top of the downhole tool string. Additionally, the reduced effective flow area between the restriction in the casing and the downhole string can result in a surge of hydraulic pressure behind the downhole tool within the casing string, further increasing the cable tension at the top of the string. In such cases, the increased cable tension can result in the downhole tool being severed from the line.

Attempts to mitigate this by controlling the surface pumps or drum spool rate can be limited by the fact that the downhole string is typically thousands of feet away, in the lateral section of the well, and any response is delayed by the speed of acquiring measurements from downhole to surface, the speed of surface mechanical systems to respond to commands and the propagation delay of any pumping pressure change or drum spooling rate change from surface to downhole. This combined delay typically takes several seconds, which is often not fast enough to regulate the downhole tension effectively.

BRIEF DESCRIPTION OF THE DRAWINGS

These drawings illustrate certain aspects of some examples of the present disclosure and should not be used to limit or define the disclosure.

DETAILED DESCRIPTION

This disclosure relates generally to downhole tools and, more particularly, embodiments related to incorporation of a pumpdown relief valve into a downhole tool that is responsive to changes in differential fluid pressure along a downhole tool. Accordingly, a system for pumpdown regulation may be provided. By inclusion of the pumpdown relief valve in the downhole tool, the systems disclosed herein assist in regulation of hydraulic forces acting on the downhole tool during pumpdown. Due to potential accelerations/decelerations of the downhole tool during pumpdown, downhole tools have to be pumped down the wellbore with care to avoid risk of separating the downhole tool from the line. In accordance with present embodiments, a pumpdown relief valve may be incorporated into the downhole tool that is responsive to changes in differential fluid pressure along the downhole tool. Embodiments of the downhole tool may include a wellbore isolation device that can seal off a portion of the wellbore and a pumpdown relief valve that allows fluid to bypass the wellbore isolation device when a differential fluid pressure across the wellbore isolation device exceeds a threshold. In some embodiments, the downhole tool may further include an elastomeric external flange and a valve member that allows fluid to bypass the elastomeric external flange when a differential fluid pressure across the elastomeric external flange exceeds a threshold. In some embodiments, the valve member may include the elastomeric external flange itself.

Figure 1:
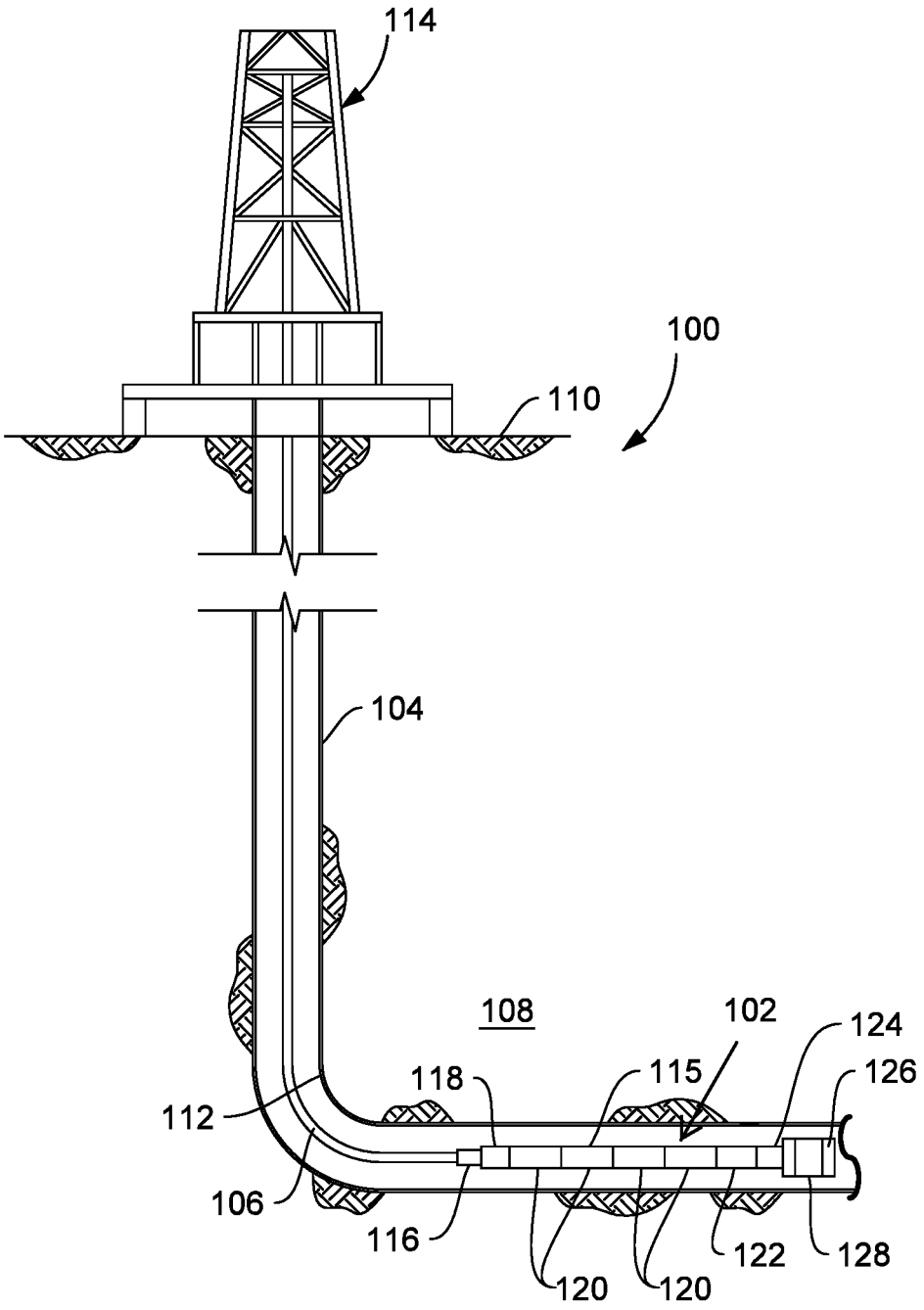
FIG. 1 is an example of well system that employs one or more principles of the present disclosure.

Referring to FIG. 1, illustrated is a system 100 for pumpdown regulation. As illustrated, system 100 may include a downhole tool 102 conveyed into wellbore 104 on line 106. Wellbore 104 may extend into a subterranean formation 108 from surface 110. Generally, wellbore 104 may include horizontal, vertical, slanted, curved, and other types of wellbore geometries and orientations. Wellbore 104 may be cased. For example, wellbore 104 may comprise a metallic material, such as tubular 112. By way of example, the tubular 112 may be a casing, liner, tubing, or other elongated steel tubular in wellbore 104. While not shown, tubular 112 may be secured within wellbore 104 by cement. As illustrated, wellbore 104 may extend through subterranean formation 108. Wellbore 104 may extend generally vertically into subterranean formation 108. However, wellbore 104 may extend at an angle through subterranean formation 108, such as in horizontal and slanted wellbores. For example, although wellbore 104 is illustrated as a vertical or low inclination angle well, high inclination angle or horizontal placement of the well and equipment may be possible. It should further be noted that while wellbore 104 is generally depicted as a land-based operation, those skilled in the art may recognize that the principles described herein are equally applicable to subsea operations that employ floating or sea-based platforms and rigs, without departing from the scope of the disclosure.

Downhole tool 102 may be supported by a rig 114 (or crane) at surface 110. Rig 114 may be any suitable rig, including, but not limited to, a drilling rig, a workover rig, a completion rig, or a crane, among others. As illustrated, downhole tool 102 may be attached to line 106 that extends from a point at surface 110, for example, rig 114 or crane. Any suitable line 106 may be used for running downhole tool 102 into wellbore 104, including, but not limited to, wireline, slickline, braided line, and coiled tubing, among others. Hydraulic pressure may be applied, for example, from surface 110, to pump the downhole tool 102 on line 106 downhole to a desired depth.

As illustrated, downhole tool 102 may include a string of tools. Downhole tool 102 may include any of a variety of tools for performing subterranean operations in wellbore 104. For example, downhole tool 102 may include a mechanical intervention services tool, a formation evaluation tool, or a perforating tool, among others. As illustrated, downhole tool 102 may include a tool body 115 with a tool head 116, a casing collar locator sub assembly 118, one or more perforating gun sub assemblies 120, a setting sub assembly 122, a pumpdown relief valve 124, and a wellbore isolation device 126.

Tool head 116 may be located at or near a proximal end of downhole tool 102. As used herein, the term "proximal" refers to the portion of downhole tool 102 (or component thereof) that is closest to the wellhead, while the term "distal" refers to the portion of downhole tool 102 (or component thereof) that is furthest from the wellhead. Tool head 116 may attach downhole tool 102 to line 106, which may include a mechanical and/or electrical connection. In some examples, tool head 116 may serve as a designated failure point if downhole tool 102 gets stuck in wellbore 104, familiar to those skilled in the art.

Casing collar locator sub assembly 118 may be any tool used for discerning the position of downhole tool 102 relative to wellbore 104, familiar to those skilled in the art. Without limitations, casing collar locator sub assembly 118 may include coils, magnets, an amplifier, and/or combinations thereof.

One or more perforating gun assemblies 120 may be located on downhole tool 102. Perforating gun assemblies 120 may be any suitable tool for creation of openings (commonly referred to as "perforations") in tubular 130. Without limitations, each of perforating gun assemblies 120 may include a firing head, a handling subassembly, a gun subassembly, and/or combinations thereof. Additionally, each of perforating gun assemblies 120 may include gun electronics, such as a selective firing switch (not illustrated) and an electronically activated detonator (not illustrated). In some examples, perforating gun assemblies 120 with a selective firing switch, may further include a memory and processor. In examples, gun electronics may store, send, and/or receive information via wired and/or wireless connections throughout downhole too 102.

Setting sub assembly 122 may also be located on downhole tool 102. Setting sub assembly 122 may be operatively coupled to wellbore isolation device 126. For example, setting sub assembly 122 may be operable to set the packer element 128 of the wellbore isolation device 126. In some embodiments, setting sub assembly 122 may include an actuator (not shown) that applies a mechanical force to a setting rod (e.g., setting rod 210 on FIG. 2), which in turn applies forces to the wellbore isolation device 126 to set the packer element 128 in place. Any suitable actuator may be used, including, but not limited to, an explosive charge that creates mechanical to drive the setting rod. Wellbore isolation device 126 may include any suitable device for isolation of portions of wellbore 104, including, but not limited to, bridge plugs and packers. Wellbore isolation device 126 may include a packer element 128. Packer element 128 may be operable to radially expand to set and form a seal in wellbore 104. The packer element 128 may be formed from an elastomer, such as a synthetic rubber, a butadiene rubber (BR), a nitrile rubber (NBR), a fluoroelastomer (FKM), Hydrogenated acrylonitrile butadiene rubber (HNBR), a perfluoroelastomer (FFKM), ethylene propylene diene monomer (EPDM), copolymer of tetrafluoroethylene and propylene (TFE/P), copolymers of hexafluoropropylene (HFP) and vinylidene fluoride (VDF, terpolymers of tetrafluoroethylene (TFE), vinylidene fluoride (VDF) and hexafluoropropylene (HFP), or other thermoset material. While wellbore isolation device 126 is shown with a packer element 128 on FIG. 1, suitable devices may be otherwise configured and utilize other suitable mechanisms for restricting flow in an annular space between downhole tool 102 and a wellbore wall and/or casing.

Pumpdown relief valve 124 may be positioned between setting sub assembly 122 and wellbore isolation device 126. Pumpdown relief valve 124 may be operable to respond directly to changes in differential fluid pressure along downhole tool 102 during pumpdown. Advantageously, the pumpdown relief valve 124 may respond to pressure changes in the order of milliseconds, thus providing near immediate relief when needed, as opposed to response times of a few seconds when controlled from surface (e.g., surface 110 on FIG. 1). It should be understood that pumpdown relief valve 124 may include surface control in addition to response to differential fluid pressure changes, as described herein. For example, pumpdown relief valve 124 may be operable to allow fluid to bypass wellbore isolation device 126 when fluid pressure across wellbore isolation device 126 is above a threshold. The threshold for activation of pumpdown relief valve 124 may vary based on a number of factors, including, but not limited to, a desired head tension. The fluid pressure that corresponds to the head tension should vary based on a number of factors, including, but not limited to, tool geometry, well geometry, fluid properties, pumping rate, and/or wireline spool rate, among others. In addition to having a threshold pressure for opening, pumpdown relief valve 124 should open further, allowing increased bypass in response to pressure increased beyond the threshold pressure. Thus, the pumpdown relief valve 124 may function as a mechanical negative feedback loop, having the effective regulating the differential fluid pressure pushing the downhole tool 102. Pumpdown relief valve 124 may operate based on any of a variety of suitable mechanisms, including, but not limited to, ball/seat valve, flapper valve, or sliding sleeve, among others. In general, pumpdown relief valve 124 may be any suitable valve operable to open in response to a rising differential fluid pressure.

In operation, downhole tool 102 may be pumped down the wellbore 104 to a desired location for well operations, such as perforating. During the pumpdown, increased differential fluid pressure may be seen across the downhole tool 102, in some instances. For example, if restrictions (e.g., sand, wellbore debris, a change in casing ID) are encountered in wellbore 104, increased differential fluid pressure can occur, resulting in potential for rapid acceleration or deceleration of the downhole tool 102. These differential fluid pressures (and resulting acceleration/deceleration) can be problematic, for example, resulting in increased force on tool head 116 with potential separation of downhole tool 102 at tool head 116, commonly referred to as pump off. By including pumpdown relief valve 124 in downhole tool 102, differential fluid pressure across the downhole tool 102 can be regulated to reduce pump off as embodiments of pumpdown relief valve 124 are responsive to changes in differential fluid pressure along downhole tool 102. During pumpdown, pumpdown relief valve 124 may be in a closed position. However, should differential fluid pressure across downhole tool 102, for example, at wellbore isolation device 126, increase above a threshold, pumpdown relief valve 124 can move to an open position, allowing fluid to bypass wellbore isolation device 126, thus relieving this pressure. In some embodiments, pumpdown relief valve 124 may be pressure activated such that pumpdown relief valve 124 opens in response to the differential fluid pressure increase across the valve. In other embodiments, pumpdown relief valve 124 may be electromechanically controlled and open in response to a tension measurement, pressure measurement, differential fluid pressure measurement, conveyance speed measurement, or other suitable parameter.

Figure 2A:
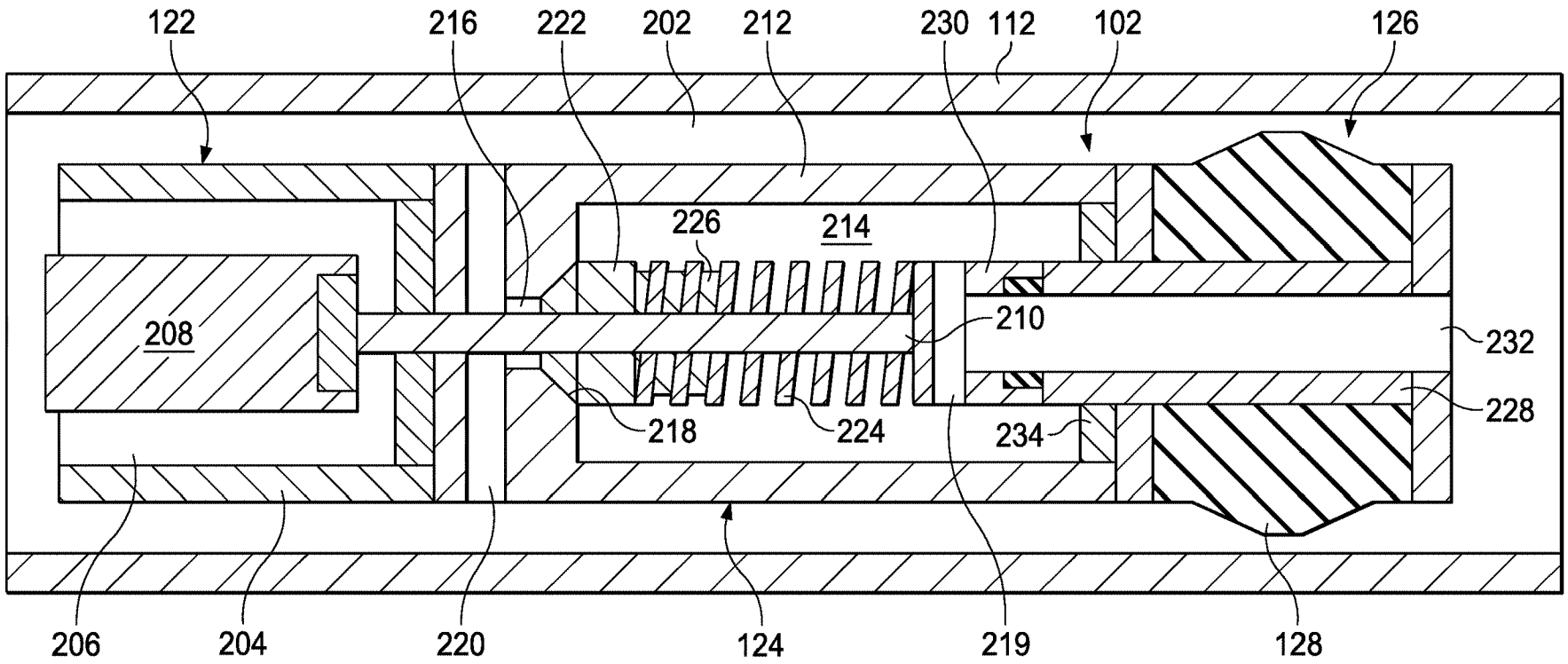
FIG. 2*a* is a cross-sectional view of an exemplary downhole tool that includes pumpdown relief valve positioned between the setting tool and the wellbore isolation device with the pumpdown relief valve in a closed position.
Figure 2B:
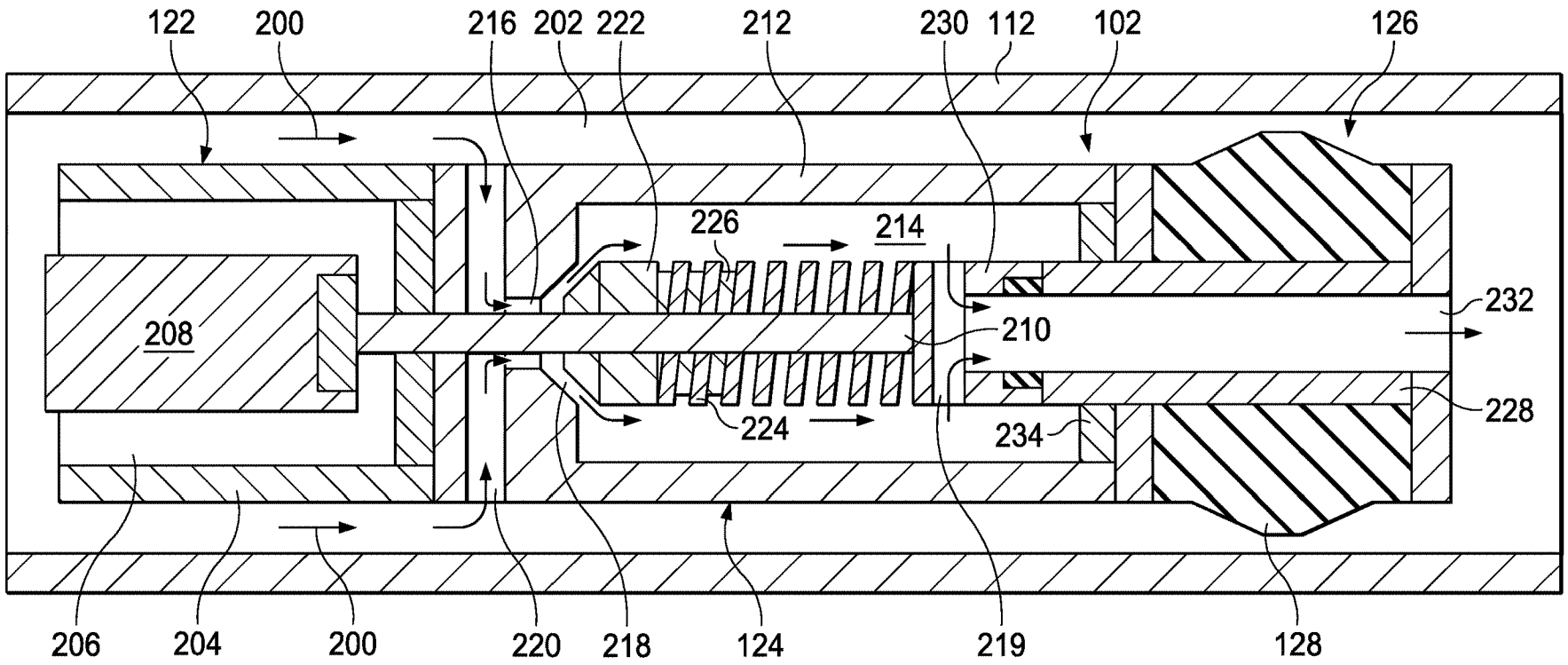
FIG. 2*b* is a cross-sectional view of an exemplary downhole tool that includes pumpdown relief valve positioned between the setting tool and the wellbore isolation device with the pumpdown relief valve in an open position.

FIGS. 2*a* and 2*b* illustrates a cross-sectional view of a portion of downhole tool 102. As illustrated, the portion of downhole tool 102 shown on FIGS. 2*a* and 2*b* includes setting sub assembly 122, pumpdown relief valve 124, and wellbore isolation device 126. As illustrated, downhole tool 102 may be in a tubular 112, such as a casing string, which may be in wellbore 104 (e.g., shown on FIG. 1). FIG. 2*a* shows pumpdown relief valve 124 in a closed position, for example, during pumpdown. FIG. 2*b* shows pumpdown relief valve 124 in an open position, for example, after opening in response to a differential fluid pressure. As illustrated, wellbore fluid (indicated by arrows 200) in an annulus 202 between downhole tool 102 and tubular 112 can bypass wellbore isolation device 126 reducing the differential fluid pressure across wellbore isolation device 126.

Setting sub assembly 122 may include a housing 204 defining a piston chamber 206 that houses a rod 208. While not shown, rod 208 may be coupled to a piston. As illustrated, setting rod 210 may be coupled to rod 208. While setting rod 210 is shown as being directly coupled to rod 208, it is also contemplated that setting rod 210 may be indirectly coupled to rod 208, for example, by one or more other structural elements (not shown) that interpose rod 208 and setting rod 210. When actuated, rod 208 may apply a mechanical force to setting rod 210 forcing setting rod 210 in the downhole direction.

Pumpdown relief valve 124 may be coupled to setting sub assembly 122. As illustrated, pumpdown relief valve 124 may be positioned between setting sub assembly 122 and wellbore isolation device 126. Pumpdown relief valve 124 may include a valve body 212 defining a valve chamber 214 opening into a valve inlet 216 and a valve exit 219 for directing wellbore fluid 200 through valve body 212. Valve inlet 216 may include an enlarged portion (e.g., a countersink) defining a valve seat 218. Valve body 212 further includes flow channels 220 for providing fluid communication between annulus 202 and valve inlet 216. Valve chamber 214 houses valve member 222. As illustrated, setting rod 210 may extend from setting sub assembly 122, through valve inlet 216, and into valve chamber 214. Valve member 222 may be slidably positioned on setting rod 210. Valve member 222 may have any suitable form, including, but not limited to, a ball or a plug. In the closed position, valve member 222 abuts valve seat 218 to form a seal that prevents flow through valve inlet 216. To hold valve member 222 in place against valve seat 218, biasing device 224 provides an axial force to valve member 222. Any suitable biasing device 224 may be used, including, but not limited to, a compression spring or a series of Belleville washers. Biasing device 224 may be positioned on a stem 226 that extends from valve member 222. Biasing device 224 may be arranged in valve chamber 214 between valve member 222 and mandrel 228. Valve exit 219 may be formed in a proximal end 230 of mandrel 228. Setting rod 210 may be attached to mandrel 228. Mandrel 228 may include a flow passageway 232 providing fluid communication between valve chamber 214 and an exterior of downhole tool 102.

In response to an increase in differential fluid pressure across wellbore isolation device 126, valve member 222 may be forced in the downhole direction compressing biasing device 224, thereby storing spring energy. As valve member 222 moves in downhole direction, valve member 222 moves out of contact with valve seat 218 such that pumpdown relief valve 124 is in an open position (as shown on FIG. 2*b*). In the open position, wellbore fluids 200 may then enter valve chamber 214 through valve inlet 216 and exit valve chamber 214 through valve exit 219 and exit downhole tool through flow passageway 232 in mandrel 228. Pumpdown relief valve sub assembly 214 should stay in the open position until sufficient fluid flow has occurred to reduce the differential fluid pressure across wellbore isolation device 126. When the spring energy in biasing device 224 overcomes the differential fluid pressure, the valve member 222 should move in the uphole direction until valve member 222 seats on valve seat 218 closing pumpdown relief valve sub assembly 214 (as shown on FIG. 2*a*).

Wellbore isolation device 126 includes one or packer elements 128 and mandrel 228. Mandrel 228 extend through distal wall 234 of valve body 212 and into valve chamber 214. One or more packer elements 128 are positioned on mandrel 228. To activate the wellbore isolation device, the setting rod 210 applies force onto wellbore isolation device 126 to set packer elements 128 in place. In some embodiments, the force from setting rod 210 cause packer elements 128 to expand radially outward and into engagement with tubular 112.

Figure 3:
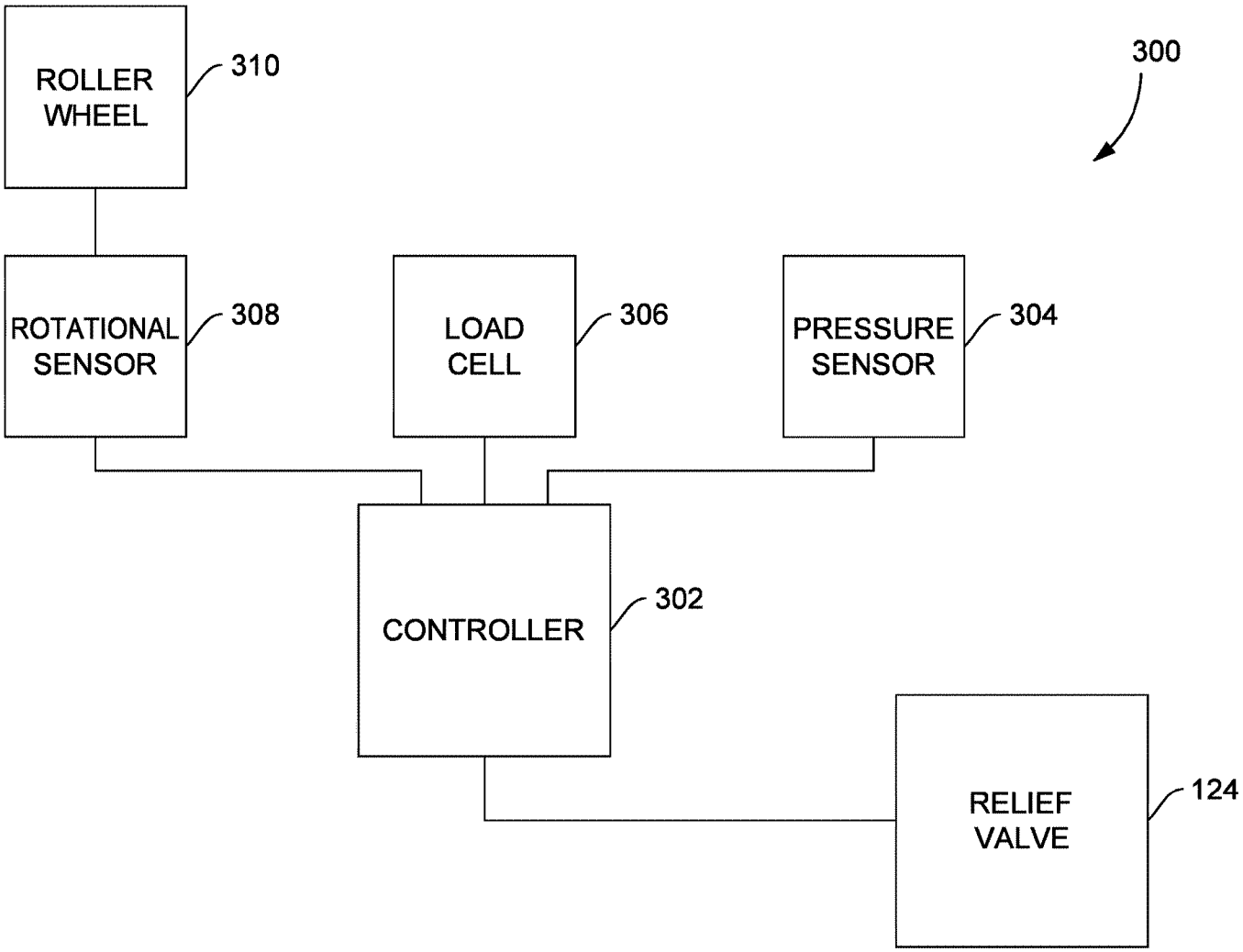
FIG. 3 is a schematic diagram illustrating control of an exemplary pumpdown relief valve.

FIG. 3 illustrates an example of a system 300 for control of a pumpdown relief valve 124. In some embodiments, pumpdown relief valve 124 may be incorporated into a downhole tool 102, as shown on FIGS. 1, 2*a*, and 2*b*. As illustrated, system 300 may include a controller 302 and one or more sensors, such as pressure sensor 304, load cell 306, and/or rotational sensor 308. Controller 302 may be any suitable controller for controlling opening and closing of pumpdown relief valve 124. Suitable controllers may include, but are not limited to, a proportional-integral-derivative (PID) controller that uses a control loop mechanism. Suitable controllers may include a microprocessor and memory. Each of the one or more sensors may be used individually (or in combination with one or more additional sensors) for control of valve subassembly. In some embodiments, pressure sensor 304 may measure differential fluid pressure across downhole tool 102 (or one or more components thereof, such as wellbore isolation device 126 on FIG. 1 or elastomeric external flange 400 on FIG. 4). In response to the measured differential fluid pressure, controller 302 could open and/or close pumpdown relief valve 124, for example, to maintain a constant differential fluid pressure across downhole tool 102. In some embodiments, load cell 306 may measure force (e.g., strain, hydraulic, etc.) at one or more points on downhole tool 102. For example, load cell 306 may be positioned on tool head 116 (e.g., shown on FIG. 1). Force measurements could be indicative of an increased differential fluid pressure. In response to force measurements, controller 302 could open and/or close pumpdown relief valve 124, for example, to reduce force. In some embodiments, rotational sensor 308 may be positioned on downhole tool 102 to measure rotation of a roller wheel 310, for example. The rotation of roller wheel 310 could be indicative of conveyance speed. Increase in rotational speed (and in turn conveyance speed) could be indicative of an increase in differential fluid pressure due to an obstruction. In response to rotation measurements, controller 302 could open and/or close pumpdown relief valve 124, for example, to increase conveyance speed (and in turn rotation speed).

Figure 4A:
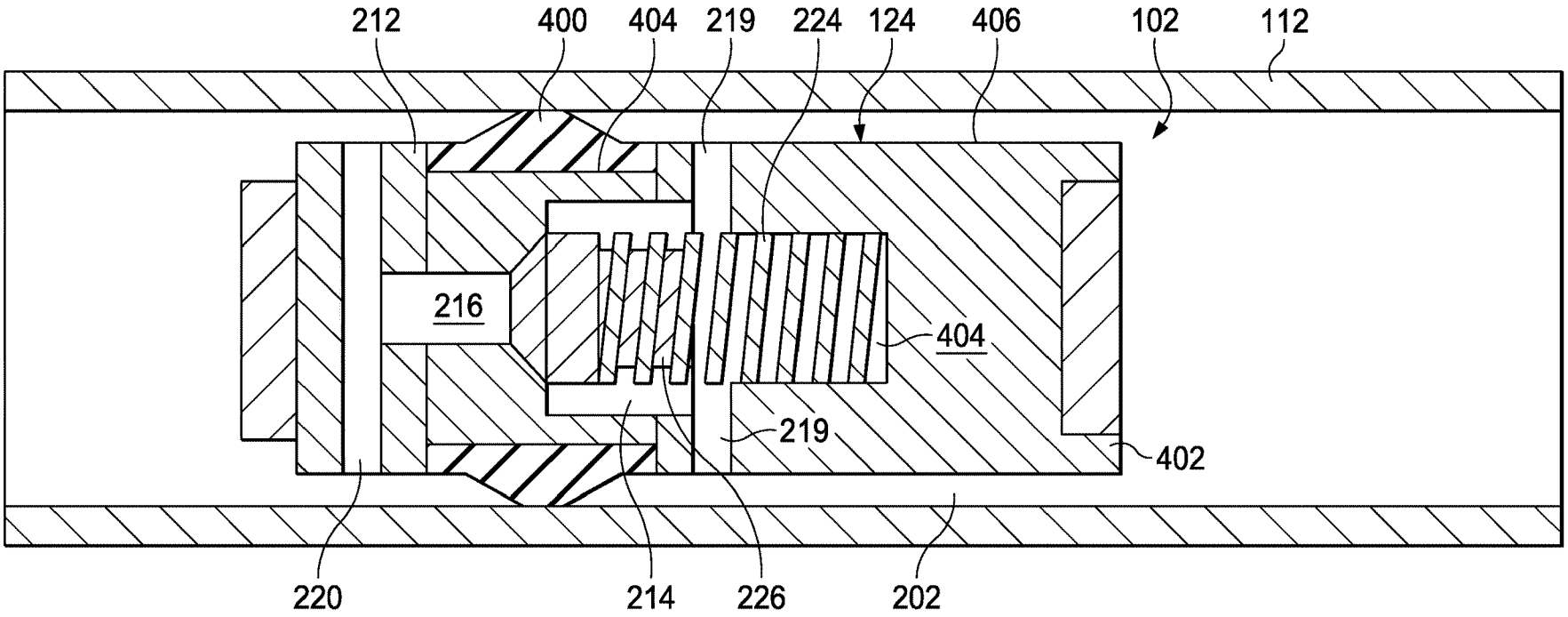
FIG. 4*a* is a cross-sectional view of another exemplary downhole tool that includes pumpdown relief valve positioned between the setting tool and the wellbore isolation device with the pumpdown relief valve in a closed position.
Figure 4B:
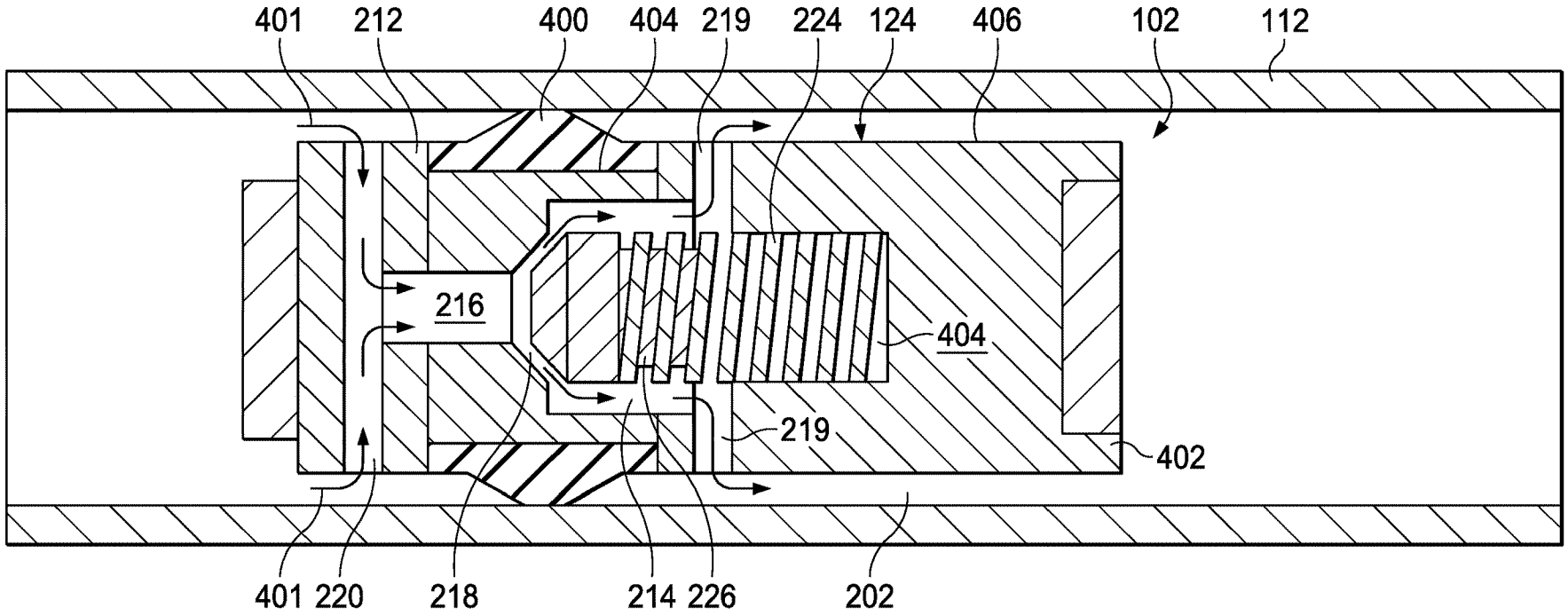
FIG. 4*b* is a cross-sectional view of another exemplary downhole tool that includes pumpdown relief valve positioned between the setting tool and the wellbore isolation device with the pumpdown relief valve in an open position.

FIGS. 4*a* and 4*b* illustrates another embodiment of a portion of downhole tool 102. In contrast to the embodiment illustrated on FIGS. 2*a* and 2*b*, the embodiment shown on FIGS. 4*a* and 4*b* integrates an elastomeric external flange 400 into pumpdown relief valve 124. As illustrated, downhole tool 102 may be in a tubular 112, such as a casing string, which may be in wellbore 104 (e.g., shown on FIG. 1). FIG. 4*a* shows pumpdown relief valve 124 in a closed position, for example, during pumpdown. FIG. 4*g* shows pumpdown relief valve 124 in an open position, for example, after opening in response to a differential fluid pressure across elastomeric external flange 400. As illustrated, wellbore fluid (indicated by arrows 401) in an annulus 202 between downhole tool 102 and tubular 112 can bypass wellbore isolation device 126 reducing the differential fluid pressure across wellbore isolation device 126.

Pumpdown relief valve 124 may include a valve body 212 defining a valve chamber 214 opening into a valve inlet 216 and one or more valve exits 219 for directing wellbore fluid 401 through valve body 212. In the illustrated embodiment, valve exits 219 are one or more channels formed in valve body 212 from valve chamber 214 to an exterior of pumpdown relief valve 124. Valve inlet 216 may include an enlarged portion (e.g., a countersink) defining a valve seat 218. Valve body 212 further includes flow channels 220 for providing fluid communication between annulus 202 and valve inlet 216. Valve chamber 214 houses valve member 222. Valve member 222 may have any suitable form, including, but not limited to, a ball or a plug. In the closed position, valve member 222 abuts valve seat 218 to form a seal that prevents flow through valve inlet 216. To hold valve member 222 in place against valve seat 218, biasing device 224 provides an axial force to valve member 222. Any suitable biasing device 224 may be used, including, but not limited to, a compression spring or a series of Belleville washers. Biasing device 224 may be positioned on a stem 226 that extends from valve member 222. Biasing device 224 may be arranged in valve chamber 214 between valve member 222 and a distal portion 402 of valve body 212. Biasing device 224 may be received in an opening (e.g., a counterbore) in distal portion 402.

Elastomeric external flange 400 may be positioned on valve body 212. As illustrated, elastomeric external flange 400 may be arranged in a recess 404 formed in an external surface 406 of valve body 212. Elastomeric external flange 400 may extend radially from valve body 212. Elastomeric external flange 400 may include any suitable elastomer, including, but not limited to, a synthetic rubber, a butadiene rubber (BR), a nitrile rubber (NBR), a fluoroelastomer (FKM), Hydrogenated acrylonitrile butadiene rubber (HNBR), a perfluoroelastomer (FFKM), ethylene propylene diene monomer (EPDM), copolymer of tetrafluoroethylene and propylene (TFE/P), copolymers of hexafluoropropylene (HFP) and vinylidene fluoride (VDF, terpolymers of tetrafluoroethylene (TFE), vinylidene fluoride (VDF) and hexafluoropropylene (HFP), or other thermoset material. In some embodiments, elastomeric external flange 400 may be a swab cup.

In response to an increase in differential fluid pressure across elastomeric external flange 400, valve member 222 may be forced in the downhole direction compressing biasing device 224, thereby storing spring energy. As valve member 222 moves in downhole direction, valve member 222 moves out of contact with valve seat 218 such that pumpdown relief valve 124 is in an open position (as shown on FIG. 4*b*). In the open position, wellbore fluids 401 may then enter valve chamber 214 through valve inlet 216 and exit valve chamber 214 through valve exits 219. Pumpdown relief valve 124 should stay in the open position until sufficient fluid flow has occurred to reduce the differential fluid pressure across elastomeric external flange 400. When the spring energy in biasing device 224 overcomes the differential fluid pressure, the valve member 222 should move in the uphole direction until valve member 222 seats on valve seat 218 closing pumpdown relief valve 124 (as shown on FIG. 4*a*). energy in biasing device 224 overcomes the differential fluid pressure, the valve member 222 should move in the uphole direction until seats on valve seat 218 closing pumpdown relief valve 124 (as shown on FIG. 4*a*).

Figure 5A:
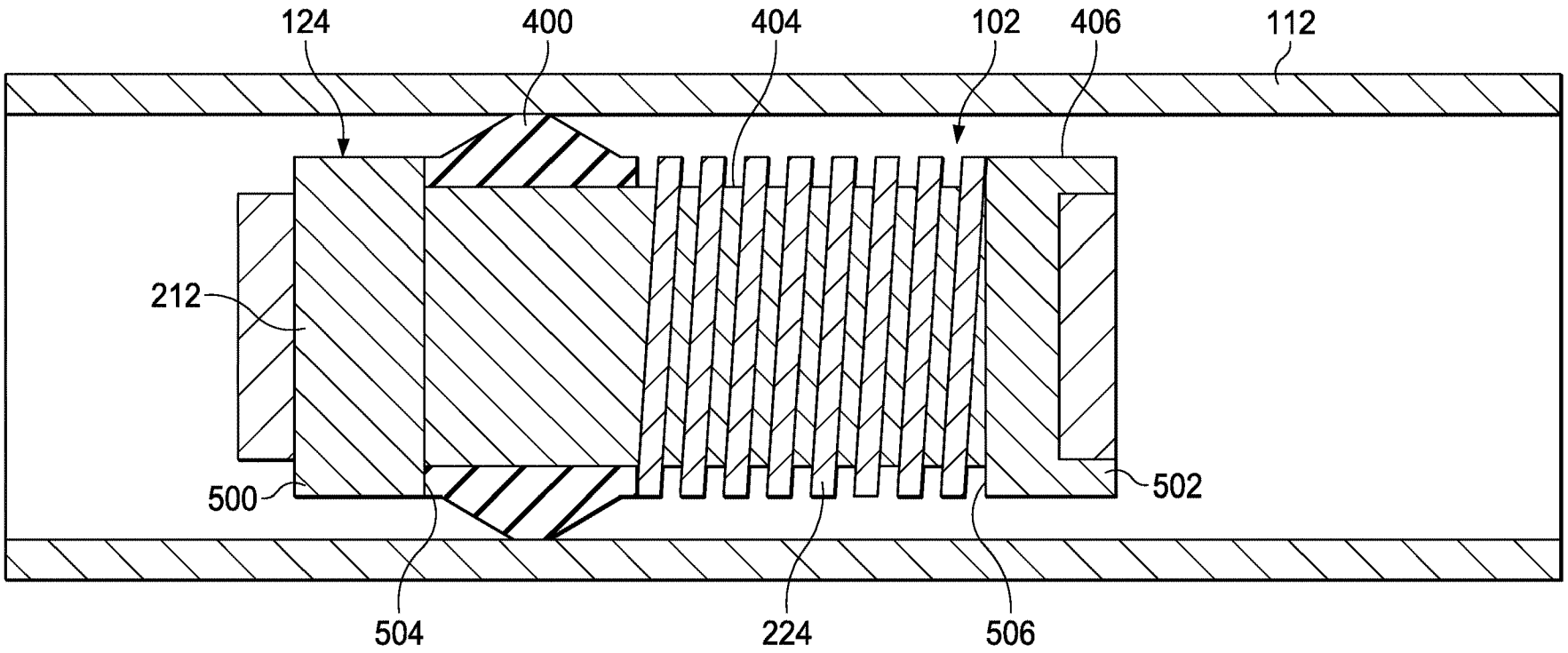
FIG. 5*a* is a cross-sectional view of yet another example downhole tool that includes a pumpdown relief valve in a closed position.
Figure 5B:
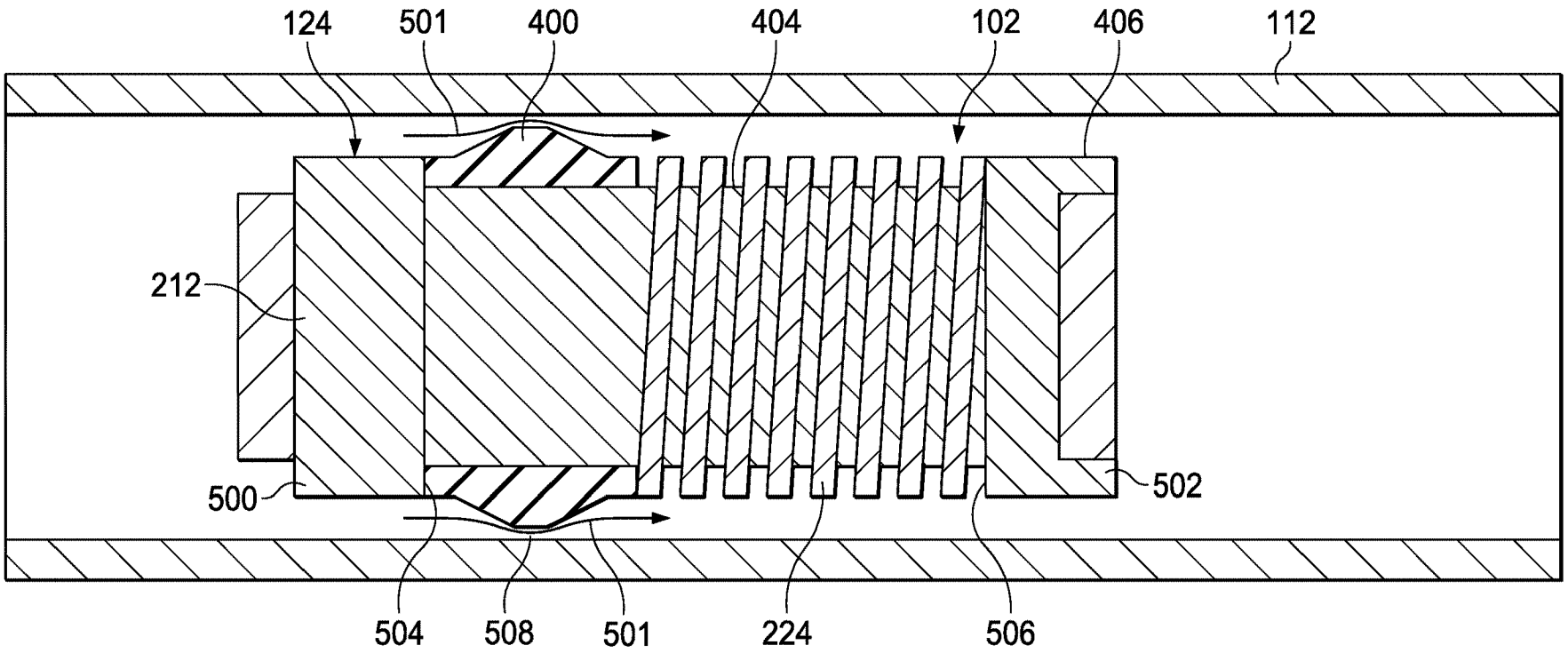
FIG. 5B is a cross-sectional view of yet another example downhole tool that includes a pumpdown relief valve in an open position.

FIGS. 5*a* and 5*b* illustrates another embodiment of a portion of downhole tool 102. In contrast to the embodiment illustrated on FIGS. 4*a* and 4*b*, the embodiment shown on FIGS. 5*a* and 5*b* integrates elastomeric external flange 400 and valve member 222 (not shown separately on FIGS. 5*a* and 5*b*). As illustrated, downhole tool 102 may be in a tubular 112, such as a casing string, which may be in wellbore 104 (e.g., shown on FIG. 1). FIG. 5*a* shows pumpdown relief valve 124 in a closed position, for example, during pumpdown. FIG. 5*b* shows pumpdown relief valve 124 in an open position, for example, after opening in response to a differential fluid pressure across elastomeric external flange 400. As illustrated, wellbore fluid (indicated by arrows 501) in an annulus 202 between downhole tool 102 and tubular 112 can bypass wellbore isolation device 126 when pumpdown relief valve 124 is in an open position.

Pumpdown relief valve 124 may include a valve body 212. Valve body 212 may have an external surface 406 with a recess 404 formed between proximal end 500 and distal end 502. Elastomeric external flange 400 may be positioned on valve body 212. As illustrated, elastomeric external flange 400 may be arranged in a recess 404 formed in an external surface 406 of valve body 212. Elastomeric external flange 400 may extend radially from valve body 212. Elastomeric external flange 400 may include any suitable elastomer, including, but not limited to, a synthetic rubber, a butadiene rubber (BR), a nitrile rubber (NBR), a fluoroelastomer (FKM), Hydrogenated acrylonitrile butadiene rubber (HNBR), a perfluoroelastomer (FFKM), ethylene propylene diene monomer (EPDM), copolymer of tetrafluoroethylene and propylene (TFE/P), copolymers of hexafluoropropylene (HFP) and vinylidene fluoride (VDF, terpolymers of tetrafluoroethylene (TFE), vinylidene fluoride (VDF) and hexafluoropropylene (HFP), or other thermoset material. In some embodiments, elastomeric external flange 400 may be a swab cup and make contact with the internal diameter of tubular 112 when pumpdown relief valve 124 is in a closed position.

Elastomeric external flange 400 may be arranged between a proximal shoulder 504 that is facing distal end 502 and a biasing device 224. Proximal shoulder 504 may be formed at an end of recess 404. Biasing device 224 may provide an axial force to elastomeric external flange 400. Any suitable biasing device 224 may be used, including, but not limited to, a compression spring or a series of Belleville washers. Biasing device 224 may be arranged in recess 404 on valve body 212 between elastomeric external flange 400 and distal shoulder 506 that faces proximal end 502. Distal shoulder 506 may be formed at an end of recess 404 that is opposite proximal shoulder 504.

In response to an increase in differential fluid pressure across elastomeric external flange 400, elastomeric external flange 400 may be forced radial inward and expand axially, thereby compressing biasing device 224 and storing spring energy. As elastomeric external flange 400 is forced inward and expands radially, elastomeric external flange 400 moves out of contact with tubular 112 such that pumpdown relief valve 124 is in an open position (as shown on FIG. 4*a*). In the open position, wellbore fluids 501 may flow past elastomeric external flange 400 in a channel 508 formed between elastomeric external flange 400 and tubular 112. Pumpdown relief valve 124 should stay in the open position until sufficient fluid flow has occurred to reduce the differential fluid pressure across elastomeric external flange 400. When the spring energy in biasing device 224 overcomes the differential fluid pressure, the elastomeric external flange 400 should compress axially and expand radially outward from axial force applied by biasing device 224 until it seats on tubular 112 closing pumpdown relief valve 124 (as shown on FIG. 5*b*).

Accordingly, the preceding description provides a downhole tool that incorporates a pumpdown relief valve responsive to changes in differential fluid pressure along the downhole tool. The apparatus, systems, and methods that incorporate the pumpdown relief valve may include any of the various features of the apparatus, systems, and methods disclosed herein, including one or more of the following statements.

Statement 1. A system for pumpdown regulation in a wellbore is provided. The system may include a downhole tool having a tool body with a tool head that is attachable to a line, the line being attached to a point at a surface of the wellbore. The system may further include a pumpdown relief valve coupled to the tool body that is operable to allow fluid to bypass the downhole tool in direct response to a differential fluid pressure across a length of the downhole tool.

Statement 2. The system of statement 1, wherein the downhole tool includes: a setting sub assembly having a housing and a setting rod positioned in the housing; a wellbore isolation device having a mandrel and one or more sealing elements positioned on the mandrel and extendable outwardly from the tool body to restrict flow in an annular spaced between a wellbore wall and/or a casing; and wherein the pumpdown relief valve includes a valve body through which the setting rod extends.

Statement 3. The system of statement 2, wherein the valve body defines a valve chamber opening into a valve exit and a valve inlet including an enlarged portion defining a valve seat.

Statement 4. The system of statement 3, wherein the valve chamber houses a valve member held in engagement with the valve seat by a biasing device applying axial force to the valve member and arranged between a mandrel and the valve member.

Statement 5. The system of statement 4, wherein the setting rod extends through the valve member and through the biasing device to engage the mandrel.

Statement 6. The system of statement 4 or statement 5, wherein the biasing device comprises a spring.

Statement 7. The system of any one of statements 4 to 6, wherein the valve member is responsive to a differential fluid pressure across downhole tool to compress the biasing device and move in a downhole direction away from valve seat to allow wellbore fluids to flow through valve chamber.

Statement 8. The system of any one of statements 2 to 7, herein flow channels in the valve body provide fluid communication between the valve inlet and an annulus formed outside the downhole tool.

Statement 9. The system of statement 1, wherein the pumpdown relief valve comprises a valve body and a valve member operatively coupled to the valve body, wherein the sealing element includes an elastomeric external flange extending from the valve body, and wherein the valve member has a closed position that prevents flow across elastomeric external flange and an open position that allows flow across elastomeric external flange.

Statement 10. The system of statement 9, wherein the valve body defines a valve chamber opening into a valve exit and a valve inlet including an enlarged portion defining a valve seat.

Statement 11. The system of statement 10, wherein the valve chamber houses a valve member held in engagement with the valve seat by a biasing device applying axial force to the valve member and arranged between a mandrel and the valve member.

Statement 12. The system of any one of statements 9 to 11, wherein the valve member is the elastomeric external flange and a biasing device positioned on the valve body provides axial force to the elastomeric external flange to hold the elastomeric external flange in a closed position with an increase in differential fluid pressure compressing the elastomeric external flange and biasing device to move the open position.

Statement 13. The system of any one of statements 9 to 12, wherein the elastometeric external flange is a swab cup.

Statement 14. The system of any preceding claim, further including a controller coupled to the pumpdown relief valve for controlling opening and closing of the pumpdown relief valve and one or more sensors.

Statement 15. The system of statement 14, wherein the one or more sensors includes at least one of a pressure sensor, a load cell, or a rotational sensor coupled to a roller wheel.

Statement 16. A method for relieving pressure across a downhole tool is provided. The method may comprise pumping a fluid into a wellbore to convey the downhole tool down the wellbore. The method may further comprise opening a pumpdown relief valve on the downhole tool to allow a portion of the fluid to bypass the downhole tool as the downhole tool is being conveyed down the wellbore, wherein the pumpdown relief valve is opened when a differential fluid pressure across a length the downhole tool rises above a threshold pressure.

Statement 17. The method of statement 16, wherein the pumpdown relief valve opens further to allow additional portions of the fluid to bypass the downhole tool as the differential fluid pressure increases.

Statement 18. The method of statement 16 or statement 17, wherein the opening the pumpdown relief valve comprises moving a valve member away from a valve seat to allow the wellbore fluid to flow through the valve body and a mandrel of a wellbore isolation device to bypass the one or more packer elements of the wellbore isolation device by flow through the downhole tool, wherein the moving the valve member compresses a biasing device generating spring energy that is released upon reduction of the differential fluid pressure to close the pumpdown relief valve.

Statement 19. The method of statement 16 or statement 17, wherein the wellbore fluid bypasses the downhole tool by flowing through one or more channels formed in a valve body to a valve inlet, through the valve inlet to a valve chamber formed in the valve body, through the valve chamber to a valve exit, through the valve exit to a flow passageway in a mandrel, and through the mandrel to exit the downhole tool.

Statement 20. The method of statement 16 or statement 17, wherein opening the pumpdown relief valve comprises compressing an elastomeric external flange that extends from the downhole tool.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A system for pumpdown regulation in a wellbore, comprising:

a downhole tool comprising a setting sub assembly having a housing and a setting rod positioned in the housing, a tool body with a tool head that is attachable to a line, the line being attached to a point at a surface of the wellbore; and a pumpdown relief valve coupled to the tool body that is operable to allow fluid to bypass the downhole tool in direct response to a differential fluid pressure across a length of the downhole tool, wherein the pumpdown relief valve includes a valve member and a biasing device adjacent to the valve member, wherein the valve member is slidably disposed on the setting rod, the setting rod extending through the valve member and through the biasing device.

2. The system of claim 1, wherein the downhole tool includes:

a wellbore isolation device having a mandrel and one or more sealing elements positioned on the mandrel and extendable outwardly from the tool body to restrict flow in an annular space between the tool body and a wellbore wall and/or a casing.

3. The system of claim 2, wherein the valve body defines a valve chamber opening into a valve exit and a valve inlet including an enlarged portion defining a valve seat.

4. The system of claim 3, wherein the valve chamber houses a valve member held in engagement with the valve seat by the biasing device applying axial force to the valve member and arranged between a mandrel and the valve member.

5. The system of claim 4, wherein the biasing device comprises a spring.

6. The system of claim 4, wherein the valve member is responsive to a differential fluid pressure across downhole tool to compress the biasing device and move in a downhole direction away from valve seat to allow wellbore fluids to flow through valve chamber.

7. The system of claim 3, wherein flow channels in the valve body provide fluid communication between the valve inlet and an annulus formed outside the downhole tool.

8. The system of claim 1, wherein the pumpdown relief valve comprises a valve body and the valve member operatively coupled to the valve body, wherein a sealing element includes an elastomeric external flange extending from the valve body, and wherein the valve member has a closed position that prevents flow across elastomeric external flange and an open position that allows flow across elastomeric external flange.

9. The system of claim 8, wherein the valve body defines a valve chamber opening into a valve exit and a valve inlet including an enlarged portion defining a valve seat.

10. The system of claim 9, wherein the valve chamber houses a valve member held in engagement with the valve seat by the biasing device applying axial force to the valve member and arranged between a mandrel and the valve member.

11. The system of claim 8, wherein the valve member is the elastomeric external flange and a biasing device positioned on the valve body provides axial force to the elastomeric external flange to hold the elastomeric external flange in a closed position with an increase in differential fluid pressure compressing the elastomeric external flange and biasing device to move the open position.

12. The system of claim 8, wherein the elastometeric external flange is a swab cup.

13. The system of claim 1, wherein the biasing device is operable to expand in an uphole direction to prevent the fluid from bypassing the downhole tool.

14. The system of claim 1, wherein the biasing device is coupled to a setting rod.

15. A system for pumpdown regulation in a wellbore, comprising:

a downhole tool having a tool body with a tool head that is attachable to a line, the line being attached to a point at a surface of the wellbore; and a pumpdown relief valve coupled to the tool body that is operable to allow fluid to bypass the downhole tool in direct response to a differential fluid pressure across a length of the downhole tool, wherein the downhole tool includes:

a setting sub assembly having a housing and a setting rod positioned in the housing;

a wellbore isolation device having a mandrel and one or more sealing elements positioned on the mandrel and extendable outwardly from the tool body to restrict flow in an annular space between the tool body and a wellbore wall and/or a casing; and wherein the pumpdown relief valve includes a valve body through which the setting rod extends, wherein the valve body defines a valve chamber opening into a valve exit and a valve inlet including an enlarged portion defining a valve seat, wherein the valve chamber houses a valve member held in engagement with the valve seat by a biasing device applying axial force to the valve member and arranged between the mandrel and the valve member, wherein the setting rod extends through the valve member and through the biasing device to engage the mandrel.

16. A method for relieving pressure across a downhole tool, comprising:

pumping a fluid into a wellbore to convey the downhole tool down the wellbore; and opening a pumpdown relief valve on the downhole tool to allow a portion of the fluid to bypass the downhole tool as the downhole tool is being conveyed down the wellbore, wherein the pumpdown relief valve is opened when a differential fluid pressure across a length the downhole tool rises above a threshold pressure, wherein the pumpdown relief valve includes a valve member and a biasing device adjacent to the valve member, wherein the valve member is slidably disposed on the setting rod, the setting rod extending through the valve member and through the biasing device.

17. The method of claim 16, wherein the pumpdown relief valve opens further to allow additional portions of the fluid to bypass the downhole tool as the differential fluid pressure increases.

18. The method of claim 16, wherein the opening the pumpdown relief valve comprises moving a ail the valve member away from a valve seat to allow the wellbore fluid to flow through the valve body and a mandrel of a wellbore isolation device to bypass the one or more packer elements of the wellbore isolation device by flow through the downhole tool, wherein the moving the valve member compresses the biasing device to generate spring energy that is released upon reduction of the differential fluid pressure to close the pumpdown relief valve.

19. The method of claim 16, wherein the wellbore fluid bypasses the downhole tool by flowing through one or more channels formed in a valve body to a valve inlet, through the valve inlet to a valve chamber formed in the valve body, through the valve chamber to a valve exit, through the valve exit to a flow passageway in a mandrel, and through the mandrel to exit the downhole tool.

20. The method of claim 16, wherein opening the pumpdown relief valve comprises compressing an elastomeric external flange that extends from the downhole tool.

* * * * *